US009490597B2

(12) United States Patent
Arcykiewicz et al.

(10) Patent No.: US 9,490,597 B2
(45) Date of Patent: Nov. 8, 2016

(54) RAIL MOUNTED ELECTRICAL CONNECTOR

(71) Applicant: Amphenol Corporation, Wallingford, CT (US)

(72) Inventors: Robert Raymond Arcykiewicz, Conroe, TX (US); William Joseph Gifford, Sugar Land, TX (US)

(73) Assignee: AMPHENOL CORPORATION, Wallingford, CT (US)

( * ) Notice: Subject to any disclaimer, the term of this patent is extended or adjusted under 35 U.S.C. 154(b) by 0 days.

(21) Appl. No.: 14/741,969

(22) Filed: Jun. 17, 2015

(65) Prior Publication Data

US 2016/0072243 A1 Mar. 10, 2016

Related U.S. Application Data

(60) Provisional application No. 62/045,930, filed on Sep. 4, 2014.

(51) Int. Cl.

| | |
|---|---|
| ***H01R 25/00*** | (2006.01) |
| ***H01R 25/14*** | (2006.01) |
| ***H01R 9/26*** | (2006.01) |
| ***H01R 13/523*** | (2006.01) |
| ***H01R 13/42*** | (2006.01) |
| ***H01R 43/16*** | (2006.01) |
| *H01R 13/518* | (2006.01) |

(52) U.S. Cl.

CPC ..... *H01R 25/142* (2013.01); *H01R 9/2616* (2013.01); *H01R 13/42* (2013.01); *H01R 13/523* (2013.01); *H01R 43/16* (2013.01); *H01R 13/518* (2013.01)

(58) Field of Classification Search

CPC .. H01R 25/14; H01R 25/142; H01R 25/147; H01R 9/2608; H01R 9/2675

USPC ..... 439/110, 121, 532

See application file for complete search history.

(56) References Cited

U.S. PATENT DOCUMENTS

| | | | | |
|---|---|---|---|---|
| 6,431,909 | B1 * | 8/2002 | Nolden | H01R 9/2608 361/735 |
| 6,767,223 | B2 * | 7/2004 | Lostoski | H01R 9/26 361/759 |
| 8,545,277 | B2 * | 10/2013 | Ondusko | G01K 7/023 439/441 |
| 8,961,201 | B2 * | 2/2015 | Griese | H01R 9/2658 439/121 |
| 2008/0108248 | A1 | 5/2008 | Lim et al. | |
| 2010/0297891 | A1 | 11/2010 | Rabbe et al. | |
| 2012/0117793 | A1 | 5/2012 | Beurthey et al. | |

FOREIGN PATENT DOCUMENTS

| | | | |
|---|---|---|---|
| GB | 1539338 | A | 1/1979 |
| GB | 2287367 | A | 9/1995 |
| WO | WO-9622554 | A2 | 7/1996 |

* cited by examiner

*Primary Examiner* — Vanessa Girardi
(74) *Attorney, Agent, or Firm* — Blank Rome LLP

(57) ABSTRACT

A submersible electrical connector that includes a first mating component that has a housing with at least one port that has a cable termination end and an opposite interface end, and the port defines a cavity that supports at least one first contact. A second mating component has a housing with at least one port that has a cable termination end and an opposite interface end configured to engage the interface end of the first mating component, and the port of the second mating component defines a cavity that supports at least one second contact configured to engage the at least one first contact. A rail engagement is disposed on at least one of the first and second mating components for mounting the connector on a DIN rail.

34 Claims, 8 Drawing Sheets

RAIL MOUNTED ELECTRICAL CONNECTOR

RELATED APPLICATION

This application claims benefit of and priority to U.S. provisional application Ser. No. 62/045,930, filed on Sep. 4, 2014.

FIELD OF THE INVENTION

The present invention relates to an electrical connector that is fluid submersible while providing separable mating components, being mountable to a DIN rail, providing compensation for pressure changes, and being easily stackable.

BACKGROUND OF THE INVENTION

Water resistance enclosures are the preferred method of protecting, consolidating and organizing electrical and electronic components used within the industrial control industry. Such enclosures may be used in robotics for ocean exploration, for example, where the enclosure holds and protects cabling for the robot or remotely operated vehicle (ROV). The typical arrangement of such an enclosure would be a five sided metal or plastic box, with a hinged cover that contains a seal, and a mechanism to secure the cover, either by fastener or latch.

Inside the bottom of these enclosures, a base plate is provided for mounting circuit breakers and the like. This base plate stands off the bottom of the enclosure and functions as a platform to attach components, such as circuit breakers, within the enclosure, so that the enclosure walls remain uncompromised and watertight. The components are mounted to the base plate using standard fasteners, e.g. machine screws and nuts.

Another popular method of mounting electrical components or subassemblies within a submersible enclosure is to employ the use of a DIN rail, named after the original German specifying organization. The DIN rail is a standardized method to mount circuit breakers and industrial control equipment in the robotics enclosure. The DIN rail is a formed metal strip that attaches to the enclosure's base plate. The form is standardized to accept components designed to mate with it. The components are typically designed to clip onto the DIN rail. There are three major forms of the DIN rail and are described by standard EN50022, and formerly German Standard DIN 46277.

A need exists, however, for a DIN rail mountable connector that includes separable mating components, such as a plug and receptacle, can withstand a significant increase in pressure, such as when descending in the ocean, and can be easily stacked on the DIN rail.

SUMMARY OF THE INVENTION

Accordingly, the present invention provides a submersible electrical connector that includes a first mating component that has a housing with at least one port that has a cable termination end and an opposite interface end, and the port defines a cavity that supports at least one first contact. A second mating component has a housing with at least one port that has a cable termination end and an opposite interface end configured to engage the interface end of the first mating component, and the port of the second mating component defines a cavity that supports at least one second contact configured to engage the at least one first contact. A rail engagement is disposed on at least one of the first and second mating components for mounting the connector on a DIN rail.

The present invention may also provide a method of stacking a plurality of submersible electrical connectors that has the steps of providing a plurality of submersible electrical connectors, each of the connectors including, a first mating component having a housing with at least one port having a cable termination end, an opposite interface end, and a block portion therebetween, the port defining a cavity supporting at least one first contact, and a second mating component having a housing with at least one port having a cable termination end, an opposite interface end configured to engage the interface end of the first mating component, and a block portion therebetween, the port of the second mating component defining a cavity supporting at least one second contact configured to engage the at least one first contact; and mounting the connectors onto the DIN rail via a rail engagement member; and stacking the plurality of connectors on the DIN rail against one another in a flush manner such that the block portions of the connectors abut one another.

The present invention may yet further provide a submersible electrical connector, that includes a first mating component that has a housing with at least one port that has a cable termination end and an opposite interface end, and the port defines a cavity that supports at least one first contact. A second mating component has a housing with at least one port that has a cable termination end and an opposite interface end configured to engage the interface end of the first mating component, and the port of the second mating component defines a cavity that supports at least one second contact configured to engage the at least one first contact. The connector further includes means for mounting the first and second mating components on a DIN rail.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE PREFERRED EMBODIMENTS

Referring to FIGS. 1-5, 6A, 6B, 7A-7C, and 8-12, the present invention provides a fluid submersible electrical connector 10, 100 that is easily mounted to a DIN rail 1, has disconnectable (pluggable) electrical mating components, and is design to facilitate stacking of multiple connectors on the DIN rail 1. The present invention provides the benefits of DIN rail mounting, preferably by a rail engagement, such as a snap-on engagement; pin and socket electrical connections; utilization of traditional or multi-element contact technology; the ability to handle power, signal, fiber, coax or a combination thereof; a pressure relief design that limits trapped air in pressure compensating (oil submerged) applications; multi-pole configurations; creepage and clearance suitable for installation within hazardous area equipment; multiple connector coupling options; accepting of a wide range of wire gage within same housing, via contact selection; housing polarization; stackability using flush sided housing to facilitate side-by-side stacking on DIN rail to minimize area, and maximize stack rigidity; single piece connector housings; and retention clips built into the contact cavities.

Figure 5:
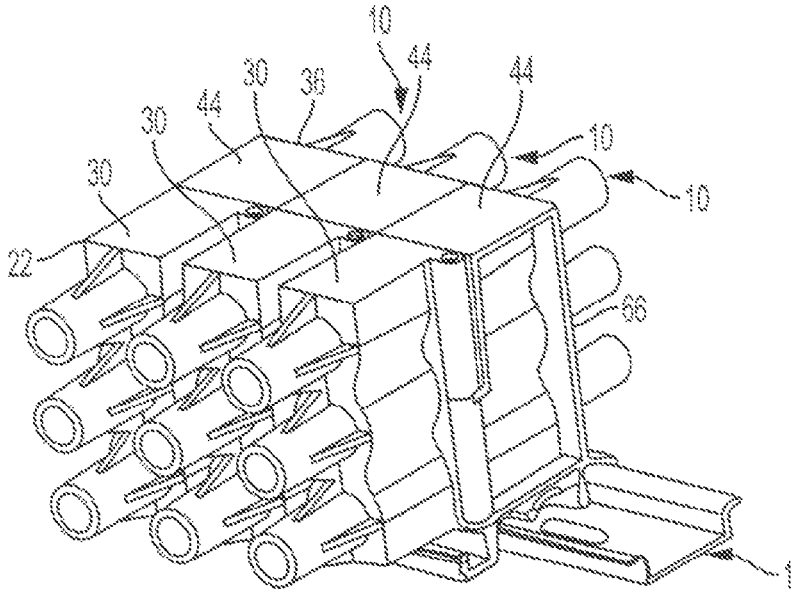
FIG. 5 is a perspective view of a plurality of the connector illustrated in FIG. 1, showing the connectors horizontally stacked on the DIN rail.
Figure 10:
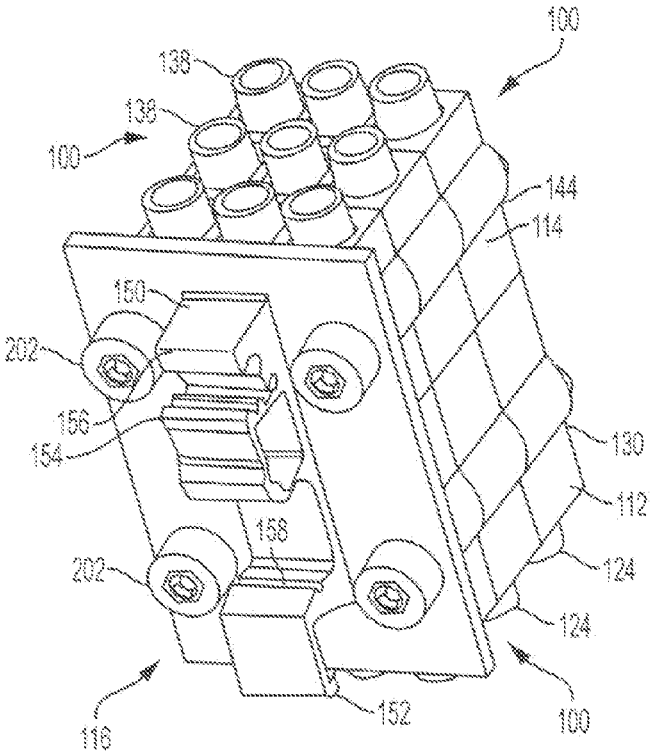
FIG. 10 is a bottom perspective view of the stacked connectors illustrated in FIG. 8 with the DIN rail removed.

The connectors of the present invention are preferably stackable, as seen in FIGS. 5 and 10. Multiple connectors may be used alongside each other along the DIN rail 1. The connectors' housings, therefore, preferably have flush sides to facilitate side-by-side stacking This minimizes the area used in the enclosure and maximizes the stack rigidity. Stacking the connectors side-by-side in accordance with the present invention does not hinder the ability to attach and remove the mating connector components from the DIN rail.

FIGS. 1-5 illustrate a first exemplary embodiment of the connector 10 of the present invention. The connector 10 generally includes first and second mating components 12 and 14, and a rail engagement 16 for mounting the connector 10 to the DIN rail 1. The first and second mating components 12 and 14 may be a plug and receptacle, respectively, wherein the first mating component 12 as one or more pin contacts 18 configured to engage one or more socket contacts 20 of the second mating component 14. The connections may be machined electrical contacts. The present invention can also utilize contacts using different designs/manufacturing processes such as: stamped and formed, forged, extruded, and the like. In a preferred embodiment, RADSOK® technology is used as the socket contact 20. RADSOK®, manufactured by Amphenol Corporation, is based upon a stamped and formed flat grid, uniquely twisted into a hyperbolic geometry to provide robust, high density contact to the mating pin contact. The RADSOK® utilizes the tensile strength properties of the flat, high conductivity alloy grid. This provides the high normal forces required for conductivity while also providing a large conductive surface area. Correspondingly low voltage drop and low temperature rise are also achieved while maintaining low insertion forces.

Figure 2:
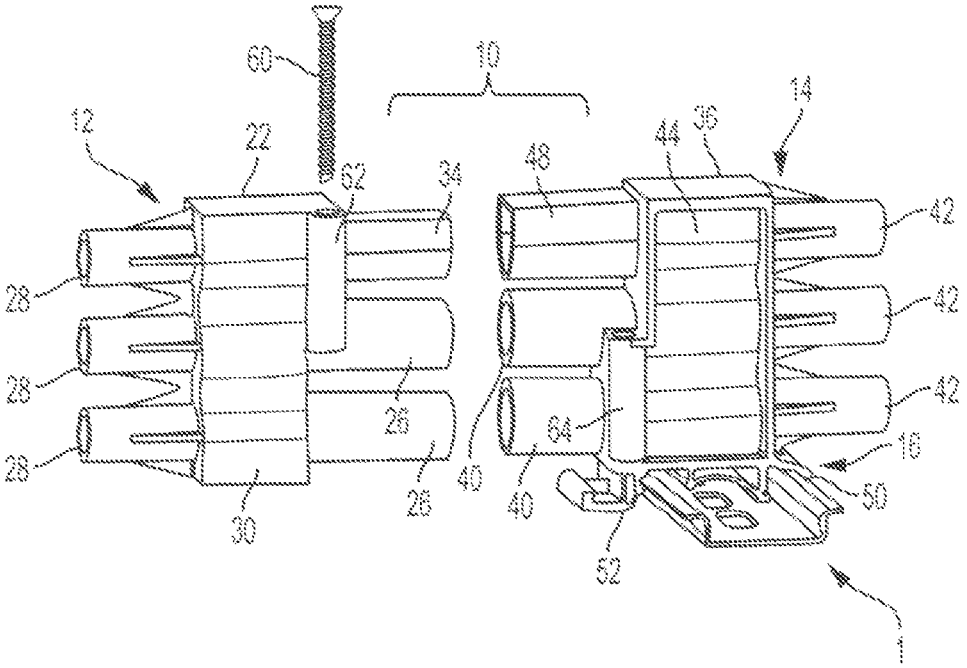
FIG. 2 is an exploded perspective view of the connector illustrated in FIG. 1.

The first mating component 12 has a housing 22 and one or more ports 24 for supporting the one or more pin contacts 18. Each port 24 has an interface end 26, an opposite cable termination end 28, and a block portion 30, therebetween. Inside each port 24 is a cavity 32 that holds an individual pin contact 18. In a preferred embodiment, the component 12 includes three ports 24 with one of the ports 24 having a different shaped interface end that has a different shape, such as a non-cylindrical shape, than the interface ends 26 of the other ports 24. That different shaped interface end defines a first key 34 of the first mating component 12, as best seen in FIG. 2, for aligning the first mating component 12 with the second mating component 14 when engaging the same.

Figure 3:
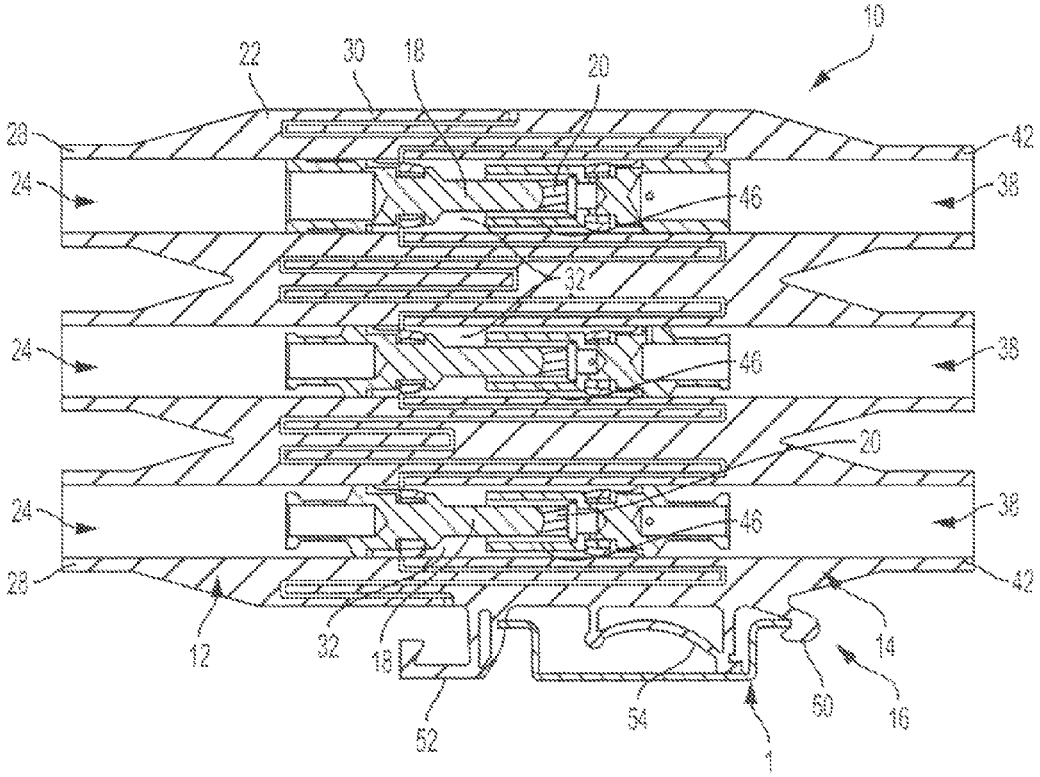
FIG. 3 is a cross-sectional view of the connector illustrated in FIG. 1.

The second mating component 14 has a housing 36 and one or more ports 38 corresponding to the ports 24 of the first mating component 12. The ports 38 support the one or more socket contacts 20, as best seen in FIG. 3. Each port 38 has an interface end 40 that is adapted to receive the interface end 26 of a corresponding port 24 of the first mating component 12, an opposite cable termination end 42, and a block portion 44, therebetween. Inside each port 38 is a cavity 46 that holds an individual socket contact 20. In a preferred embodiment, the component 14 includes three ports 38 with one of the ports 38 having a different shaped interface end that has a different shape, such as a non-cylindrical shape, than the interface ends 40 of the other ports 38. That different shaped interface end defines a second key 48 of the second mating component 12, as best seen in FIG. 2, for aligning the second mating component 14 with the first mating component 12 when engaging the same.

The connector 10 of the present invention provides modular contact cavities. Rather than having a single housing dedicated to, for example, three contact positions, the housings 22 and 26 are made modular. Smaller housings could be made that are single cavity contact housings and they could be designed to fit together to make any plurality of ports and contact cavities. The initial housing would be a base housing that would be configured to mate with the DIN rail. The other connector housings would be positioned and attached to any side of the base housing forming a multi-position/cavity assembly.

Figure 4:
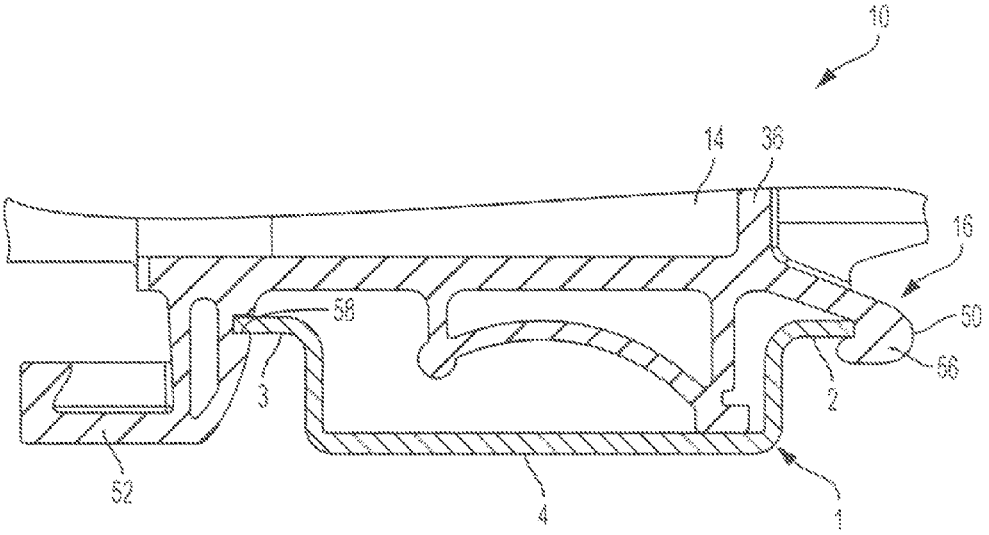
FIG. 4 is an enlarged partial elevational view of a rail engagement of the connector illustrated in FIG. 1.

The rail engagement 16 is designed to facilitate mounting of the connector 10 onto the DIN rail 1, preferably in a snapping manner, where the connector can also be easily released from the rail. The rail engagement 16 could use other types of engagement, rather than snapping, such as latching. As seen in FIG. 4, the rail engagement 16 may generally include a snap end 50, a grooved end 52 opposite the snap end 50, and a support member 54 therebetween.

The snap end 50 includes a flexible catch 56 that hooks onto a first side 2 of the DIN rail 1, for snappingly engaging the DIN rail 1. The grooved end 52 includes a lateral groove 58 located and sized to receive a second side 3 of the DIN rail 1. The support member 54 between the two ends rests on the base 4 of the DIN rail 1. The rail engagement 16 is preferably disposed on the housing 36 of the second mating component 14; however, the rail engagement 16 may be disposed on either component 12 and 14. The rail engagement 16 may be formed integrally with the housing 36 or may be formed separately and attached to the housing 36.

Figure 1:
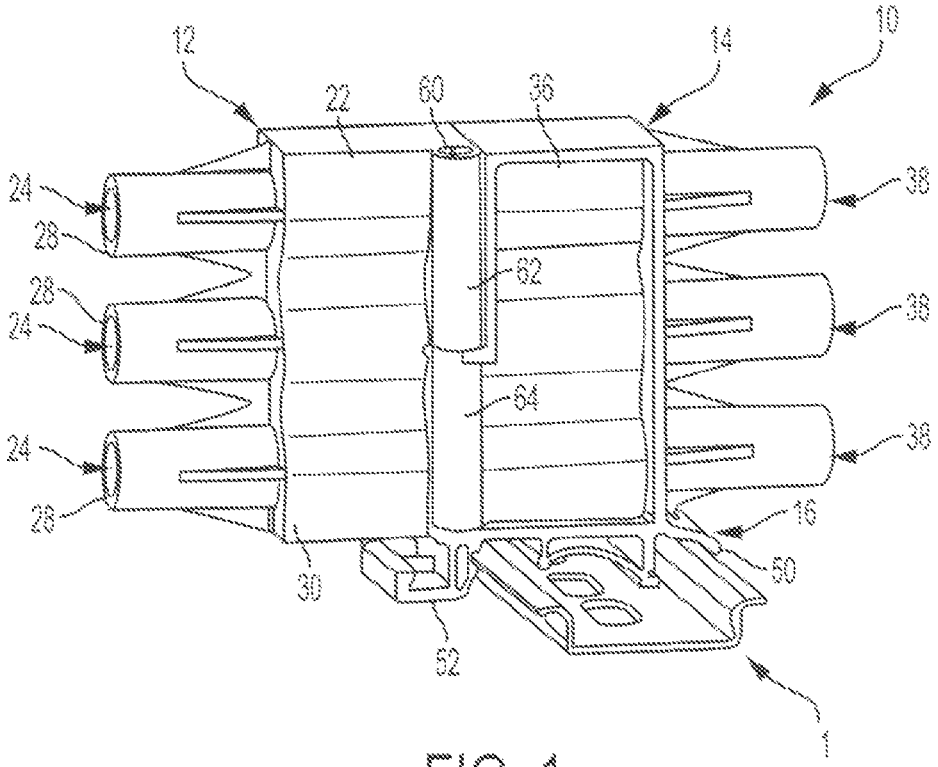
FIG. 1 is a perspective view of a submersible electrical connector according to a first exemplary embodiment of the present invention, showing the connector mounted on a DIN rail.

The first and second mating components 12 and 14 may be securely fastened together using a coupling component 60. Any known fastening mechanism may be used to mate the two housings or components of the connector 10 together. For example, the coupling component 60 may be a screw fastener that is extended through cooperating and axially aligned bores 62 and 64 of the housings 22 and 36 of the first and second mating components 12 and 14, as seen in FIGS. 1 and 2.

The threaded fastener is inserted from top of the housing 22 through bore 62 and threads into the receiving end of the bore 64 of the housing 36. Alternatively, the bores may include a tri-lobular feature that allows for the threaded fastener 60 to remain attached to the housing even when the housing is not paired with its counterpart. A shoulder may be molded in the bore that permits the fastener to enter through the bore, and once through, prevents it from detaching itself from the housing. Another alternative method for coupling the housings 22 and 36 is with a common cotter pin instead of a threaded fastener. The straight end of the pin may be inserted through the bore 62 in the housing 22 and into the bore 64 of the housing 36. This allows for quick attachment and release. Another option for mating is using a latching mechanism. A latch may be incorporated into the housing 22 of the first component 12, on the top, bottom or any side of the housing, and a reciprocal latch may be provided on the housing 36 of the second component 14. A clip may also extend from the housing 22 of the first component 12 can attach to the housing 36 of the second component to ensure securement.

As seen in FIG. 5, the connector 10 is designed to facilitate stacking of multiple connectors on the DIN rail 1. More specifically, the block portions 30 and 44 of the first and second mating components 12 and 14 allow multiple connectors 10 to be horizontally stacked on the DIN rail 1 such that the connectors 10 are flush or nearly flush against one another. A frame 66 may be provided on the block portion 44 of the housing 36 of the second component 14 to facilitate this flush stacking while also accommodating the coupling component 60. Each connector 10 is individually mounted to the DIN rail 1, using the rail engagement 16.

Figure 6A:
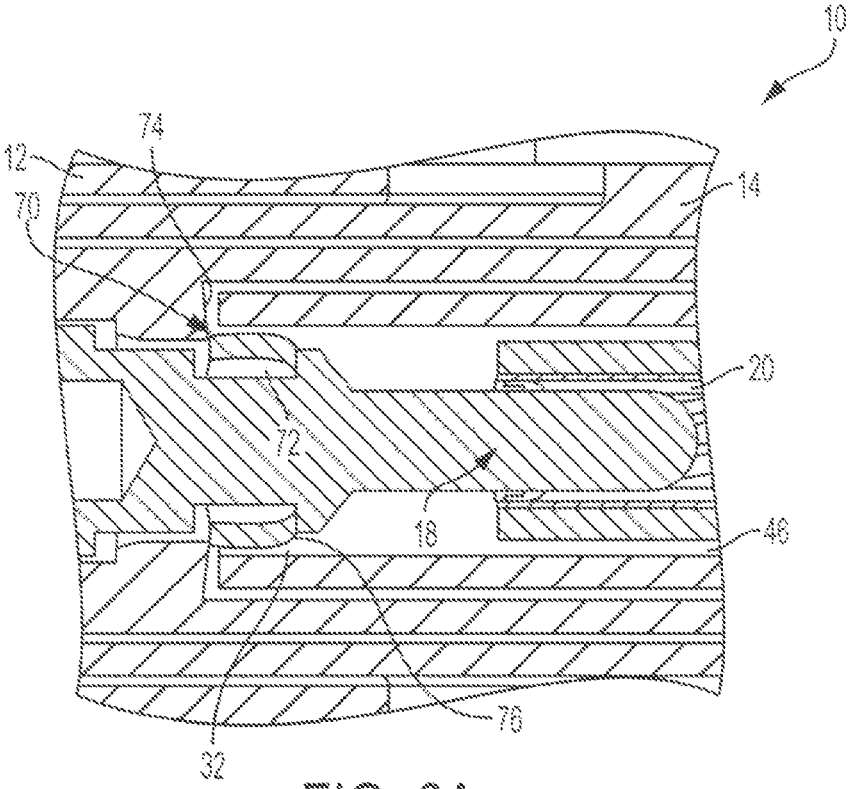
FIGS. 6A and 6B are enlarged partial cross-sectional views of the connector illustrated in FIG. 1, showing a retention clip of the connector.
Figure 6B:
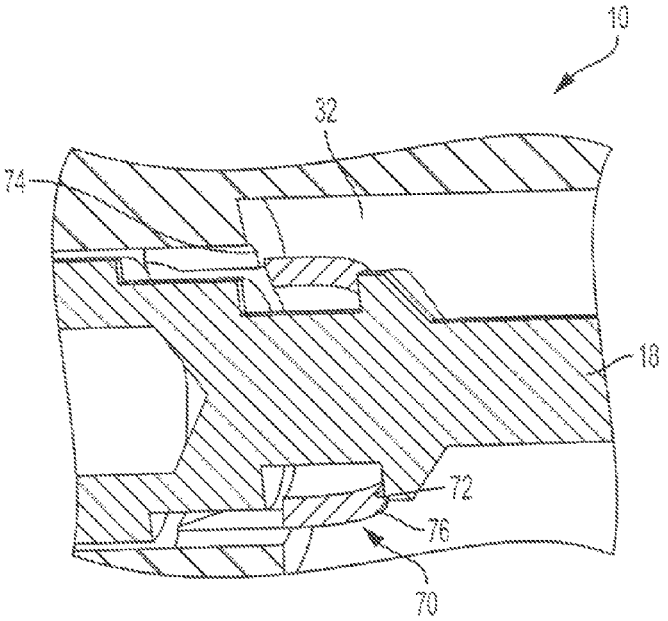

Each of the cavities 32 of the first mating component 12 and each of the cavities 46 of the second mating component 14, may include a retention clip 70 for retaining the pin and socket contacts 18 and 20 in the cavities 32 and 46, respectively, as seen in FIGS. 6A and 6B. The retention clip 70 is designed to sit within the cavities 32 and 46 and abut a shoulder 72 on the contacts and a shoulder 74 of the cavities 32 and 46. After the contact 18, 20 is crimp terminated onto a wire or cable conductor, the contact 18, 20 is pushed into the respective housing cavity 32, 46. The retention clip 70 is compressed as it goes through this shoulder, and expands, once beyond it. The retention clip 70, now expanded back to its original state, wedges itself between the contact and the housing, locking the contact within the housing. The retention 70 clip may be made of injection molded plastic, and preferably has a hollow-cylindrically shaped, with a section cutout of its wall to allow for narrowing of its outer diameter. The ends of the retention clip 70 may be designed with an angled face 76. These faces 76 act to expand the retention clip 70 within the shoulder 72 of the contact when a force is placed on the cable conductor, in the direction of contact extraction. This wedges the retention clip 70 into the corner of the housing shoulder 74 and beneficially distributes the loads, thereby lowering the shearing forces. The force vectors are angled into the body of the housing as opposed to a direction that attempts to shear the mating shoulder out of the housing.

Figure 7A:
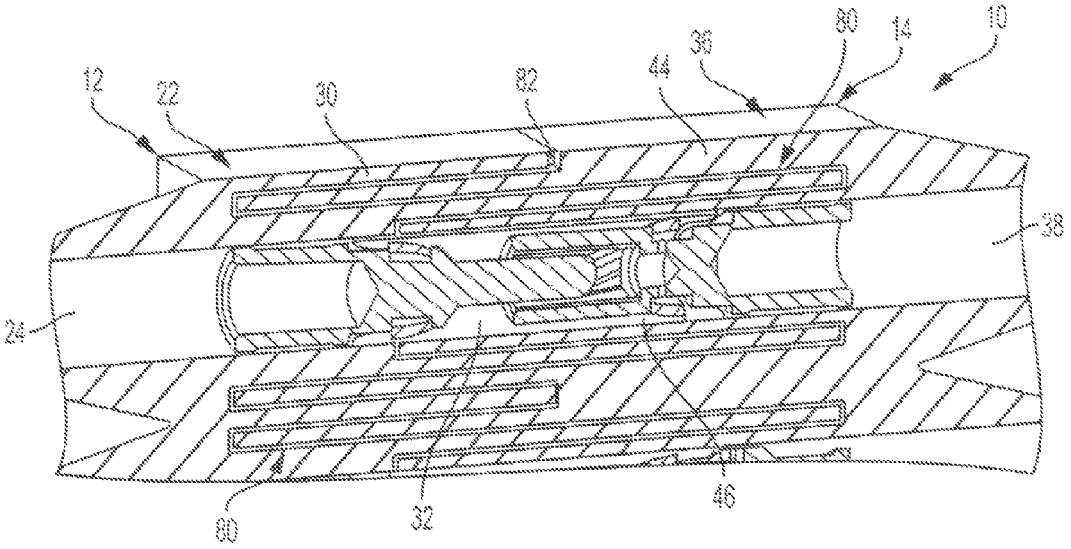
FIG. 7A is a partial cross-sectional view of the connector illustrated in FIG. 1, showing a pressure relief path of the connector.
Figure 7B:
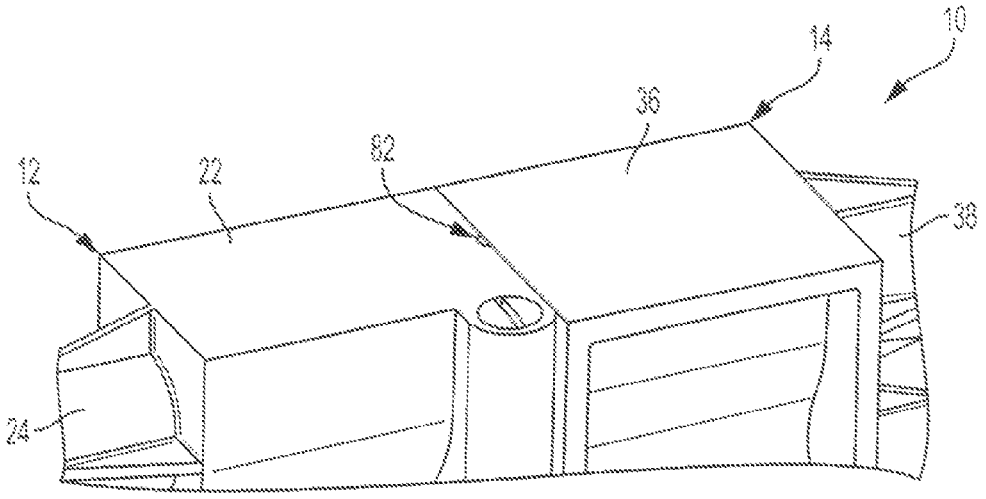
FIG. 7B is a partial enlarged perspective view of the connector illustrated in FIG. 1, showing an outlet of the connector.
Figure 7C:
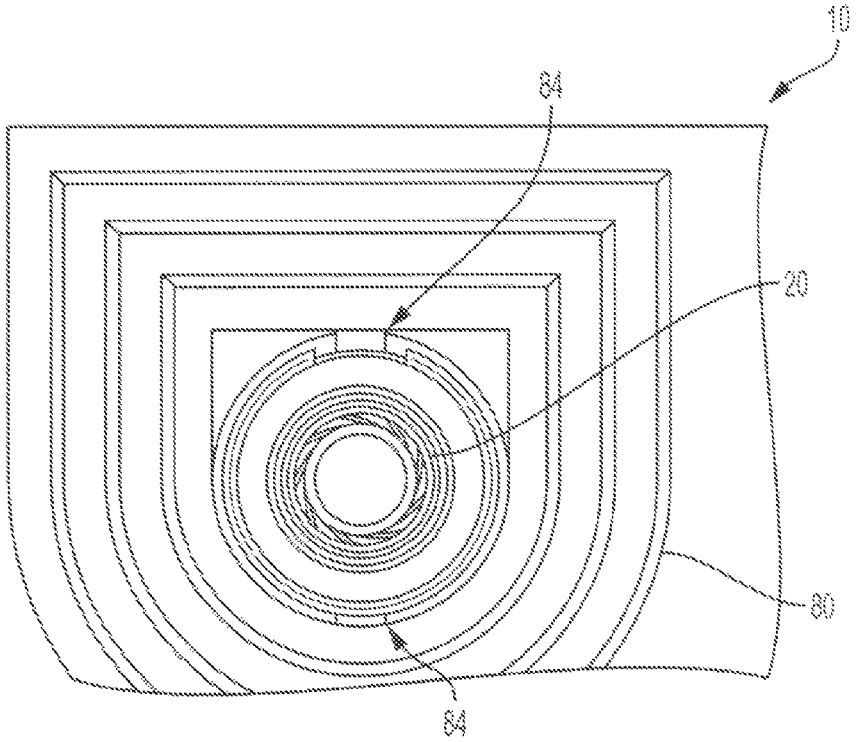
FIG. 7C is a partial end view of a socket port of the connector illustrated in FIG. 1, showing the pressure relief path.
Figure 8:
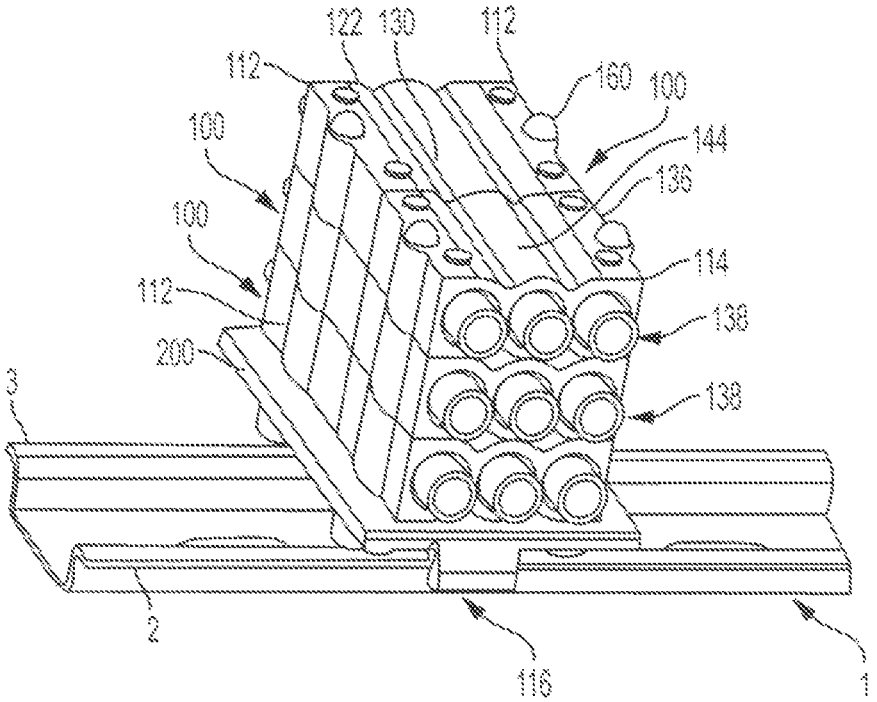
FIG. 8 is a perspective view of a submersible electrical connector according to a second exemplary embodiment of the present invention, showing a plurality of the connectors vertically stacked on a DIN rail.

Due to the depth and rate in which an enclosure holding the connector 10 may descend, the connector 10 preferably includes a pressure relief feature, as illustrated in FIGS. 7A-7C. The pressure relief feature includes a path 80 for fluid to successfully travel through, thereby allowing pockets of air to be displaced. The fluid may be any dielectric medium, such as oil. When descending to certain depths at certain rates, pressure outside the enclosure significantly increases. That causes any air pockets within the connector to shrink. The reverse is true as well. When it ascends, the air pockets augment. In order to ensure that the connector will not fracture in the event that any air still within the connector expands, the pressure relief path 80 is provided for the air to escape. The pressure relief path 80 is preferably defines an S-shaped pattern in the block portions 30 and 44 of the first and second components 12 and 14. The pressure relief path 80 is in fluid communication with the contact cavities 32 and 46 at one end 82 (FIG. 7A) of the path and in fluid communication with the exterior of the connector 10 via an outlet 82 (FIG. 7B). The outlet 82 may be disposed in one or more of the top, bottom and side walls of the component housings 22 and 36. The pressure relief path 80 may also extend around the cavities 32 and 46 of the components, as seen in FIG. 7C. Air may also escape through the tolerance located within each mated pole 24 and 38 and outlets on the exterior of one or more of the components 12 and 14 of the connector. Air can travel around the cylindrical walls of the ports 24 and 38 as it is submersed in a liquid. The liquid can fill the voids pushing the air pockets out of the connector. In addition, each shoulder that holds the contacts 18 and 20 via the retention clip 70 may have one or more paths 84 that also allow liquid to flow in and remove air.

Creepage distance is the shortest path across the insulation surface between two conductive parts. Proper creepage distance protects against tracking, which is an electrical leak that could cause deterioration on the surface. Clearance distance denotes the shortest path through air between two conductive parts. Adequate clearance helps prevent dielectric breakdown between electrodes caused by the ionization of air. Both creepage and clearance are preferred to avoid any potential failure within the product. The required distances vary depending on voltage, location and material. For the connector of the present invention, the creepage and clearance are measured from contact to contact per housing. The mating end of the contact preferably either meets or exceeds the required distances as specified in IEC-60079-7, specification for hazardous area equipment. The same is true for the crimp end. For the receptacle housing, creepage and clearance also proves acceptable from the contacts to the DIN rail.

FIGS. 8-12 illustrate a second exemplary embodiment of a submersible electrical connector 100 of the present invention. The connector 100 of the second embodiment is substantially similar to the connector 10 of the first embodiment, except that the rail engagement 116 of connector 100 includes a base plate 200 for supporting one or more of the connectors. This base plate 200 also allows multiple connectors 100 to be stacked in a vertical manner, one on top of the other, on the DIN rail 1. Also, instead of using a coupling component that fastens the first and second mating components together as in the first embodiment, the coupling component 160 of the second embodiment fastens the first and second mating components 112 and 114 to the base plate 200.

Figure 11:
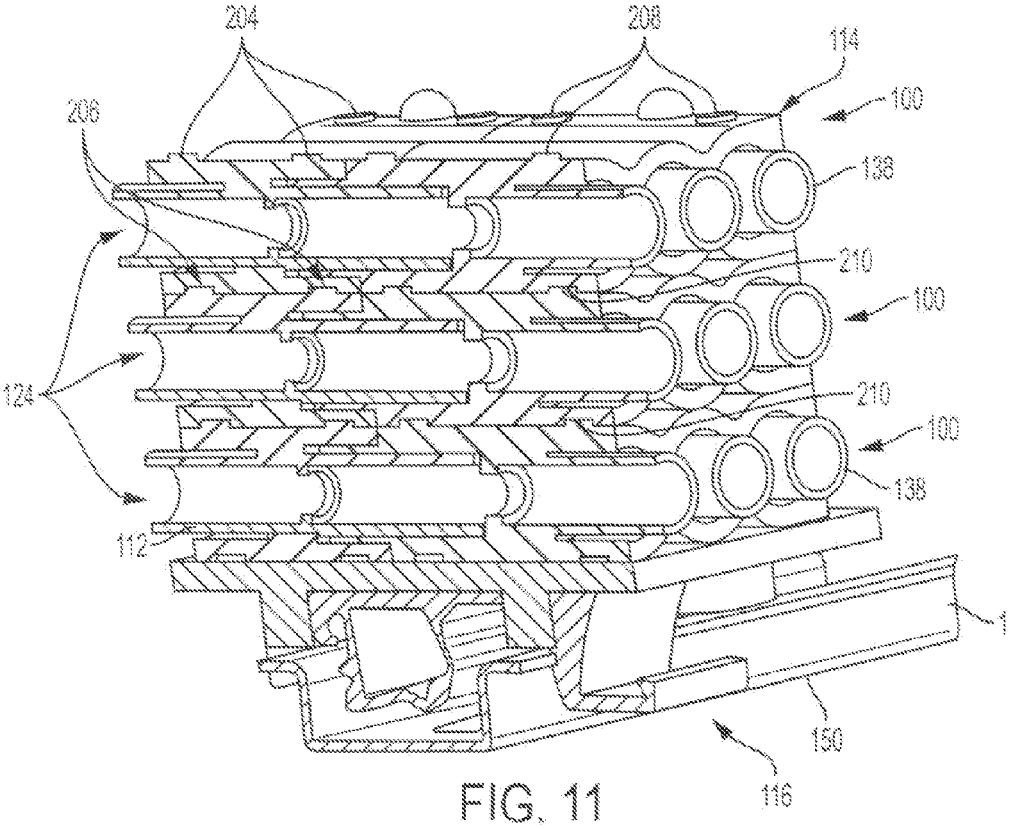
FIG. 11 is another cross-sectional perspective view of the stacked connectors illustrated in FIG. 8.
Figure 12:
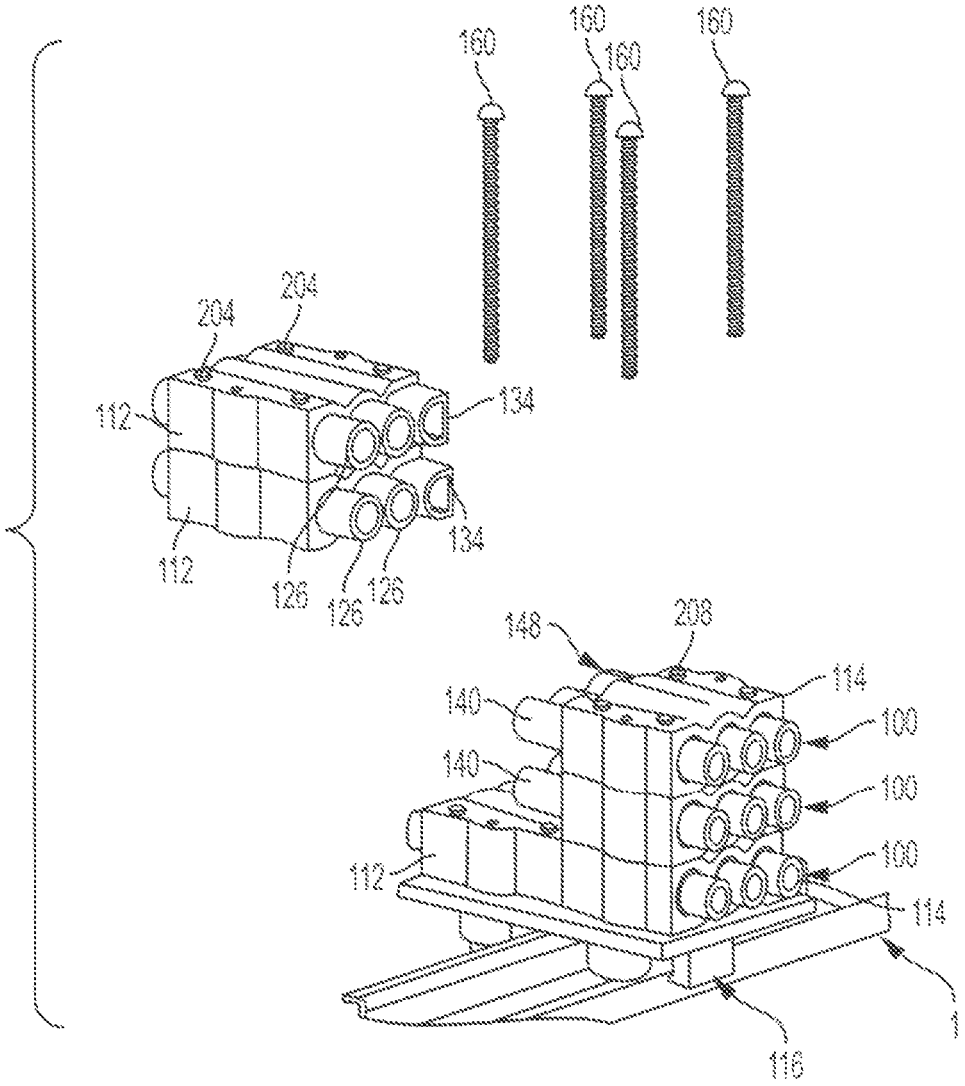
FIG. 12 is an exploded perspective view of the stacked connectors illustrated in FIG. 8.

Similar to the first embodiment, the first mating component 112 of the second embodiment has a housing 122 and one or more ports 124 for supporting one or more contacts. Each port 124 has an interface end 126, an opposite cable termination end 128, and a block portion 130, therebetween. The block portion 130 may include detents 204 on one side and indents 206 on an opposite side of the housing 122, which facilitate vertical stacking and alignment of like mating components 112, as seen in FIGS. 11 and 12. That is, the detents of one first mating component 112 may be received in the indents of another first mating component 112 when vertically stacked together. Such detents 204 substantially prevent the stacked mating components from moving with respect to one another. The component 112 includes at least one of port 124 that has a different shaped interface end that has a different shape, such as a non-cylindrical shape, than the interface ends 126 of the other ports 124, thereby defining a first key 134.

The second mating component 114 has a housing 136 and one or more ports 138 corresponding to the ports 124 of the first mating component 112. The ports 138 support the one or more contacts. Each port 138 has an interface end 140 that is adapted to receive the interface end 126 of a corresponding port 124 of the first mating component 112, an opposite cable termination end 142, and a block portion 144, therebetween. Like the first mating component 112, the block portion 144 includes detents 208 and opposite indents 210 to facilitate vertical stacking of multiple components 114. And like the first mating component 112, at least one port 138 of the second mating component 114 defines a second key 148 for aligning the second mating component 114 with the first mating component 112 when engaging the same.

Figure 9:
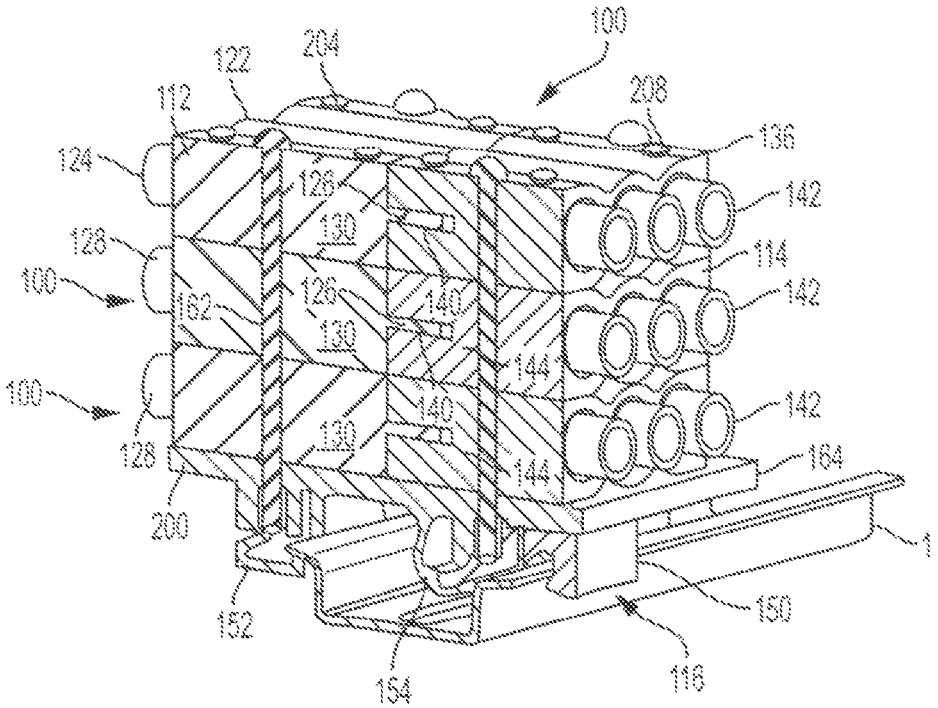
FIG. 9 is a cross-sectional perspective view of the stacked connectors illustrated in FIG. 8.

The rail engagement 116 of the second embodiment is similar to the rail engagement 16 of the first embodiment, except for the base plate 200. The base plate 200 is configured to span along a portion of the length of the DIN rail 1. A single or multiple connectors 100 may be fastened to the base plate 200 by extending a coupling component 160, such as a treaded fastener, through designated bores 162 and 164 in the housings of the first and second mating components, as seen in FIGS. 9 and 12. Anchors 202 may be provided on the base plate 200 for receiving the ends of the threaded fasteners 160.

Like the rail engagement 16 of the first embodiment, the rail engagement 116 of the second embodiment may generally include a snap end 150, a grooved end 152 opposite the snap end 150, and a support member 154 therebetween. The snap end 150, grooved end 152 and support member 154 extend from the base plate 200 away from the stacked connectors, as seen in FIG. 10. The rail engagement 116 including the base plate 200 may be formed as a unitary one-piece member, or the snap end 150, grooved end 152 and support member 154 may be separately attached to the base plate 200. The snap end 150 includes a flexible catch 156 that hooks onto a first side 2 of the DIN rail 1, for snappingly engaging the DIN rail 1. The grooved end 152 includes a lateral groove 158 located and sized to receive a second side 3 of the DIN rail 1. The support member 154 between the two ends rests on the base 4 of the DIN rail 1.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law. For example, the first and second mating components may be either plug or receptacle components supporting either pin or socket contacts. The connector of the present invention may accept a range of conductor sizes. The mating end of the contacts may remain the same, however the contact wire wells may be sized to accommodate different wire sizes. In this commonality, the housings accept all contacts, regardless of wire size.

What is claimed is:

1. A submersible electrical connector, comprising:

a first mating component having a housing with at least one port having a cable termination end and an opposite interface end, said port defining a cavity supporting at least one first contact;

a second mating component having a housing with at least one port having a cable termination end and an opposite interface end configured to engage said interface end of said first mating component, said port of said second mating component defining a cavity supporting at least one second contact configured to engage said at least one first contact; and means for mounting the first and second mating components on a DIN rail.

2. A submersible electrical connector according to claim 1, further comprising means for fastening the first and second mating components together.

3. A submersible electrical connector according to claim 1, further comprising means for fastening the first and second mating components to the means for mounting.

4. A submersible electrical connector according to claim 1, further comprising means for stacking on the housing of at least one of the first and second mating components.

5. A submersible electrical connector, comprising:

a first mating component having a housing with at least one port having a cable termination end and an opposite interface end, said port defining a cavity supporting at least one first contact;

a second mating component having a housing with at least one port having a cable termination end and an opposite interface end configured to engage said interface end of said first mating component, said port of said second mating component defining a cavity supporting at least one second contact configured to engage said at least one first contact; and a rail engagement disposed on at least one of said first and second mating components for mounting the connector on a DIN rail.

6. A submersible electrical connector according to claim 5, wherein said first mating component is a plug and said first contact is a pin; and said second mating component is a receptacle and said second contact is a socket.

7. A submersible electrical connector according to claim 5, further comprising an elastic retention clip provided in said cavities of said first and second mating components, said retention clips retaining said at least one first or second contacts in said first and second mating components, respectively.

8. A submersible electrical connector according to claim 7, wherein each of said retention clips includes an angular face that abuts a shoulder of said cavity of said first and second mating components, respectively.

9. A submersible electrical connector according to claim 5, wherein each housing said first and second mating components includes a block portion between said interface and cable termination ends, said block portion is adapted to facilitate stacking of the connector.

10. A submersible electrical connector according to claim 9, wherein said block portions include at least one detent and at least one indent opposite said at least one detent.

11. A submersible electrical connector according to claim 5, wherein said first mating component includes a plurality of ports, each port of said plurality of ports has a cable termination end and an opposite interface end, and defines a cavity that supports another first contact; and said second mating component includes a plurality of ports, each port of said plurality of ports of said second mating component has a cable termination end and an opposite interface end, and defines a cavity that supports another second contact.

12. A submersible electrical connector according to claim 11, wherein said interface end of at least one of said ports of said first mating component has a different shape than said interface ends of the other of said plurality of ports, thereby defining a first key; and said interface end of at least one of said ports of said second mating component has a different shape than said interface ends of the other of said plurality of ports of said second mating component, thereby defining a second key, wherein said first and second keys correspond to provide alignment when mating said first and second mating components.

13. A submersible electrical connector according to claim 5, further comprising a component coupling for fastening said first and second mating components together.

14. A submersible electrical connector according to claim 13, wherein said component coupling includes a fastener that engages corresponding bores of said housings of said first and second mating components.

15. A submersible electrical connector according to claim 13, wherein said component coupling includes corresponding latching members of said housing of said first and second mating components.

16. A submersible electrical connector according to claim 5, wherein said rail engagement includes a snap end for engaging one side of the DIN rail and a groove end for engaging a second side of the DIN rail, and a support member between said snap end and groove end.

17. A submersible electrical connector according to claim 16, wherein said rail engagement is integrally formed with said housing of said second mating component.

18. A submersible electrical connector according to claim 5, wherein said rail engagement includes a base plate supporting said first and second mating components.

19. A submersible electrical connector according to claim 5, further comprising a pressure relief path defined in said housings of said first and second mating components, said pressure relief path is in fluid communication with said cavities of said first and second mating components and in fluid communication with the exterior of said housings; thereby allowing air to escape said first and second mating components.

20. A submersible electrical connector according to claim 19, wherein said pressure relief path is adapted to receive a dielectric fluid.

21. A submersible electrical connector according to claim 19, wherein said pressure relief path defines an S-pattern in said housings of said first and second mating components.

22. A submersible electrical connector according to claim 19, wherein said pressure relief path extends around said cavities of said housings of said first and second mating components.

23. A method of stacking a plurality of submersible electrical connectors, comprising the steps of:

providing a plurality of submersible electrical connectors, each of the connectors including, a first mating component having a housing with at least one port having a cable termination end, an opposite interface end, and a block portion therebetween, the port defining a cavity supporting at least one first contact, and a second mating component having a housing with at least one port having a cable termination end, an opposite interface end configured to engage the interface end of the first mating component, and a block portion therebetween, the port of the second mating component defining a cavity supporting at least one second contact configured to engage the at least one first contact; and mounting the connectors onto the DIN rail via a rail engagement member; and stacking the plurality of connectors on the DIN rail against one another in a flush manner such that the block portions of the connectors abut one another.

24. The method according to claim 23, wherein the rail engagement includes a snap end and a grooved end, the snap and grooved ends engaging opposite sides of the DIN rail.

25. The method of claim 23, wherein the step of mounting includes snapping the connectors to the DIN rail via the rail engagement.

26. The method of claim 23, further comprising the step of providing a pressure relief path in the first and second mating components of each connector, the pressure relief path being in fluid communication with the cavities of the first and second mating components and the exterior of the connectors.

27. The method of claim 23, wherein the first mating component includes a plurality of ports, each port of the plurality of ports has a cable termination end and an opposite interface end, and defines a cavity that supports another first contact; and the second mating component includes a plurality of ports, each port of the plurality of ports of the second mating component has a cable termination end and an opposite interface end, and defines a cavity that supports another second contact.

28. The method of claim 27, further comprising the step of keying at least one port of the first mating component of each connector to at least one port of the second mating component of each connector, thereby aligning the first and second mating components of each connector, respectively.

29. The method according to claim 23, wherein the step of stacking includes vertically stacking the connectors on top of one another on the DIN rail.

30. The method according to claim 29, wherein the step of stacking includes vertically aligning the connectors using corresponding detents and indents in the housings of the connectors.

31. The method according to claim 29, further comprising the step of fastening the vertically stacked connectors to the rail engagement.

32. The method according to claim 23, wherein the step of stacking includes horizontally stacking the connectors on the DIN rail, such that each connector engages the DIN rail.

33. The method according to claim 32, further comprising the step of fastening the first mating component to the second mating component of each connector using a coupling component.

34. The method according to claim 33, wherein the rail engagement includes a base plate that supports the connectors.

* * * * *